US006644567B1

(12) United States Patent
Adams et al.

(10) Patent No.: US 6,644,567 B1
(45) Date of Patent: Nov. 11, 2003

(54) REMOTELY OPERATED CUTTING MODE SHIFTING APPARATUS FOR A COMBINATION FLUID JET DECOKING TOOL

(75) Inventors: Douglas Adams, Fullerton, CA (US); Jay Roger Clark, Laguna Niguel, CA (US); Lloyd D. Hanson, Long Beach, CA (US); Martin Prescott, Downey, CA (US); Robert M. Purton, Corona, CA (US); Richard Tran, San Gabriel, CA (US)

(73) Assignee: Flowserve Management Company, Irving, TX (US)

( * ) Notice: Subject to any disclaimer, the term of this patent is extended or adjusted under 35 U.S.C. 154(b) by 0 days.

(21) Appl. No.: 10/185,303

(22) Filed: Jun. 28, 2002

(51) Int. Cl.[7] ..... A62C 31/00; B05B 1/20

(52) U.S. Cl. ..... 239/566; 239/438; 239/442; 239/447

(58) Field of Search ..... 239/436, 438, 239/443, 446, 447, 449, 566, 569, 581.1, 581.2, DIG. 13; 74/424.94, 424.71; 251/62, 63–5

(56) References Cited

U.S. PATENT DOCUMENTS

| | | | | |
|---|---|---|---|---|
| 4,275,842 A | | 6/1981 | Purton et al. | |
| 4,611,613 A | * | 9/1986 | Kaplan | 134/95 |
| 4,626,320 A | * | 12/1986 | Alworth et al. | 201/2 |
| 4,738,399 A | | 4/1988 | Adams | |
| 4,828,651 A | | 5/1989 | Lumbroso et al. | |
| 4,923,021 A | | 5/1990 | Courmier et al. | |
| 5,794,729 A | | 8/1998 | Van Meter et al. | |
| 5,816,505 A | | 10/1998 | Tran et al. | |
| 5,855,742 A | | 1/1999 | Lumbroso et al. | |
| 6,240,946 B1 | * | 6/2001 | Beasley | 137/15.06 |

* cited by examiner

*Primary Examiner*—Kevin Shaver
*Assistant Examiner*—Anuradha Ramana
(74) *Attorney, Agent, or Firm*—Dinsmore & Shohl, LLP

(57) ABSTRACT

A remotely operated cutting mode shifting apparatus for use with a decoking tool of the type in which the cutting mode is changed by rotation of a diverter valve plate, has a shifter body adapted for mounting to the decoking tool and a control rod for engaging with the diverter valve plate. It includes a mechanism within the shifter body for rotating the control rod to drive the diverter valve plate to shift the cutting mode of the decoking tool upon release of cutting fluid pressure from the tool.

5 Claims, 3 Drawing Sheets

REMOTELY OPERATED CUTTING MODE SHIFTING APPARATUS FOR A COMBINATION FLUID JET DECOKING TOOL

BACKGROUND OF THE INVENTION

This invention relates generally to decoking of delayed petroleum coke vessels and more particularly to combination decoking tools having capability for remotely operated cutting mode shifting.

In a delayed coker operation of a petroleum refinery, heavy hydrocarbon (oil) is heated to 900° F.–1000° F. in large fired heaters and transferred to cylindrical vessels known as coke drums which are as large as 30 feet in diameter and 140 feet in height. The heated oil releases its hydrocarbon vapors for processing into useful products, leaving behind solid petroleum coke which must be removed from the vessel in the decoking cycle of the coker operation in order to prepare the coke drum for further hydrocarbon processing.

Decoking is accomplished using high pressure water jets in two phases. First, a pilot hole, 3 feet to 4 feet in diameter, is cut, or drilled, downward from the top of the vessel through the coke bed using downward oriented nozzles of the decoking tool. Then, the decoking tool is raised to the top of the vessel where either the whole tool or the cutting mode of a combination decoking tool is changed to use sideward oriented nozzles, and the tool, rotated and moved vertically downward in the pilot hole, cuts the balance of the coke and flushes it out the open bottom of the vessel. Removal of the tool from the vessel to either change it out or to change its cutting mode, is a cumbersome and time consuming operation which, considering the cost and limited number of coke vessels, can significantly impact the production capacity of a refinery. Thus, there has been a continuing interest in combination decoking tools which are capable of remotely activated cutting mode shifting. So far, all attempts at providing such tools have failed because of mechanical jamming of mode shifting mechanisms caused by suspended coke debris in the cutting fluid. The debris is the result of recycling of the cutting fluid. Since all previous designs included some form of shuttle valve driven by through-flowing cutting fluid, all were subject to jamming due to debris carried in the cutting fluid which settled or was filtered out of the fluid and gathered between sliding surfaces of valve members. Thus, the very fluid needed to operate the shifting mechanism was the ultimate cause of the failure of the mechanism. In addition, these designs accomplished cutting mode shifting by application of full cutting fluid pressure, thereby increasing friction forces and exacerbating the jamming tendency of the debris laden shuttle devices.

A relatively trouble-free, manually shiftable, combination decoking tool was developed and was described in U.S. Pat. No. 5,816,505, which is commonly owned herewith and is incorporated herein by reference. The trouble-free nature of this tool is attributable to its mode shifting valve design which includes only a rotatable diverter plate for selectively directing cutting fluid to either pilot hole drilling nozzles or full-width coke cutting nozzles. This eliminated most of the moving parts of other shifting mechanisms and; because of the simple rotatable flat diverter plate acting on the flat diverter valve body, it also eliminated the multiple interfaces between parts which provided the jamming sites which caused the failures of earlier designs of remotely operated shifting devices. In spite of these improvements, the tool still needed to be removed from the coke drum in order to change the cutting mode. Thus, there is still no commercially successful decoking tool with a remotely operable cutting mode shifting mechanism.

The foregoing illustrates limitations known to exist in currently available decoking tools. Thus, it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a remotely operated cutting mode shifting apparatus for use with a decoking tool of the type in which the cutting mode is changed by rotation of a diverter valve plate, the apparatus comprising a shifter body adapted for mounting to said decoking tool and having a control rod for engaging with the diverter valve plate; and means within the shifter body for rotating the control rod to drive the diverter valve plate to shift the cutting mode of the decoking tool upon release of cutting fluid pressure from the tool.

The foregoing and other aspects will become apparent from the following detailed description of the invention when considered in conjunction with the accompanying drawings.

DETAILED DESCRIPTION

Figure 1:
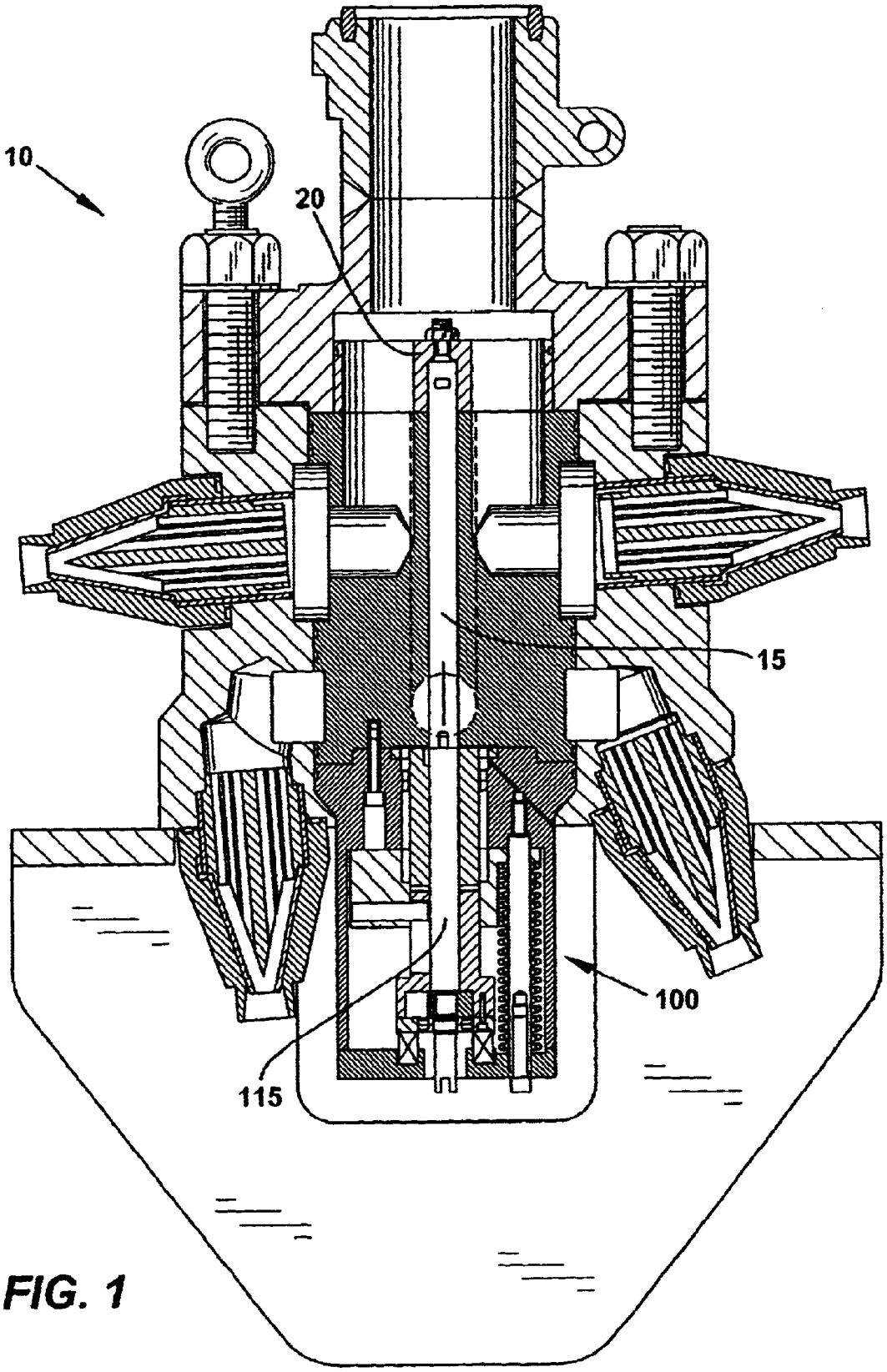
FIG. 1 is a schematic partially sectional elevation view of a decoking tool, having a rotatably operated cutting mode shifting valve member, with a remotely activated cutting mode shifting apparatus according to the invention.

FIG. 1 shows a decoking tool 10 with a cutting mode shifting apparatus 100 mounted to its bottom. The lower control rod 115 of the shifting apparatus is keyed to the upper control rod 15 to operate the rotatable diverter plate 20 in response to shifting actions triggered by depressurizations and repressurizations of the shifting apparatus. Because of the very high (typically more than 4,000 psi) cutting fluid differential pressure across the diverter plate 20 at the unpressurized ports of the decoker body, the diverter plate and body are pressed together by at least 20,000 pounds force Therefore, the shifting apparatus of the invention was designed to accomplish shifting during the depressurized stage of shifter operation. This feature alone provides a quantum improvement in shifting performance when compared to shifting of other remotely shifted combination decoking tools which are actuated by the pressurization stage. Since frictional forces are highest during the pressurization stage of operation, it is clear that any shifting is best accomplished during the pressure-free stage of operation. The invention may be understood by reference to FIGS. 2–7 which show individual details of the decoking tool and its novel method of operation.

Figure 2:
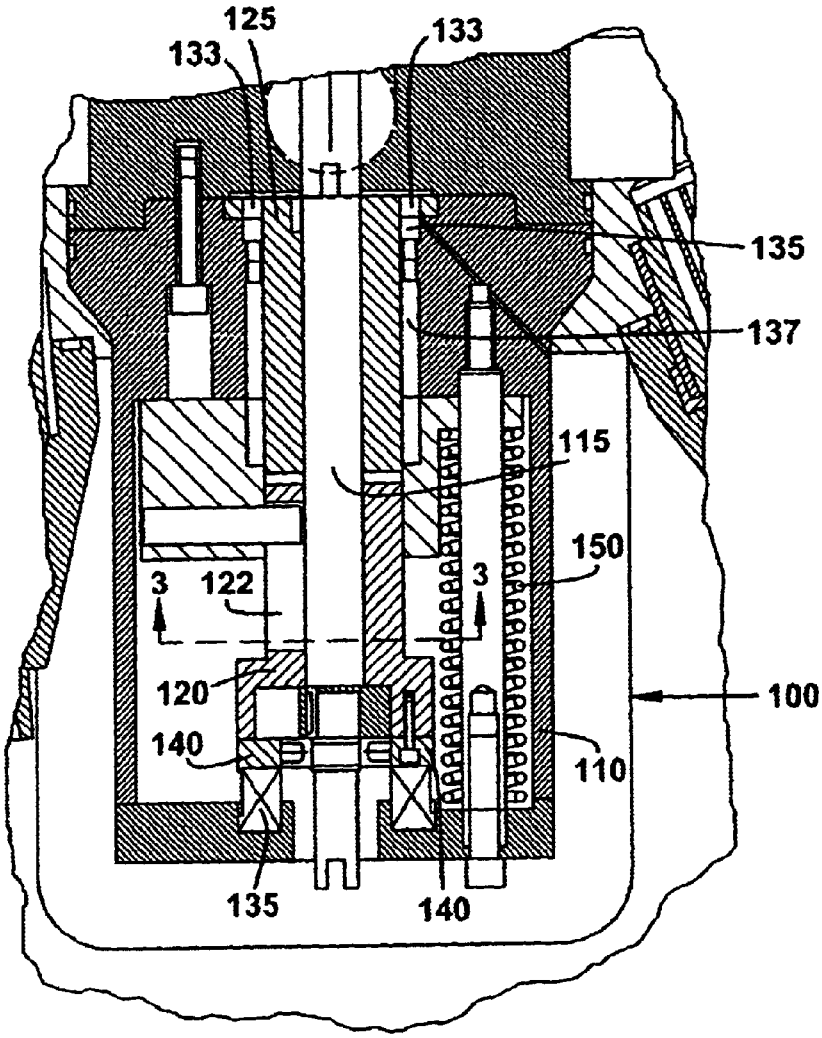
FIG. 2 is a schematic sectional view of the remotely operated cutting mode shifting apparatus showing greater detail of its construction.

FIG. 2 shows an enlarged sectional view of the shifting apparatus 100 which includes a shifter body 110 attached to the bottom of the decoking tool 10. A liner sleeve 125 surrounds the lower control rod 115 and abuts the bottom of the decoking tool There is a gap between the liner sleeve 125 and the surrounding shifter body 110 which forms an annular hydraulic cylinder 135 for driving an annular piston 137 downward when the hydraulic cylinder 135 is pressurized with cutting fluid. Pressurization is accomplished through fluid ports 133 in the top of the liner sleeve 125. The annular piston 137 drives an actuator pin carrier 105 which carries at least one radially inwardly projecting actuating pin 107.

Figure 3:
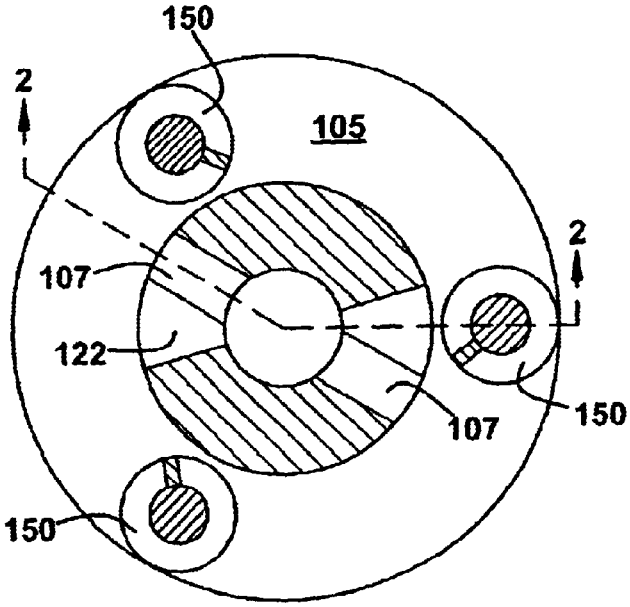
FIG. 3 is a schematic sectional view taken along the line 3—3 of FIG. 2.
Figure 4:
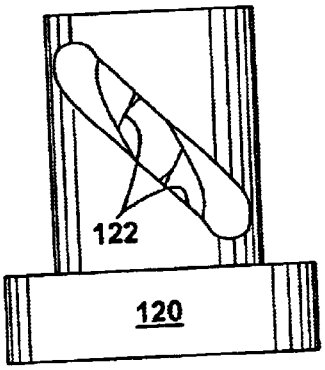
FIGS. 4 and 5 are two schematic views of the actuator sleeve of the invention.
Figure 5:
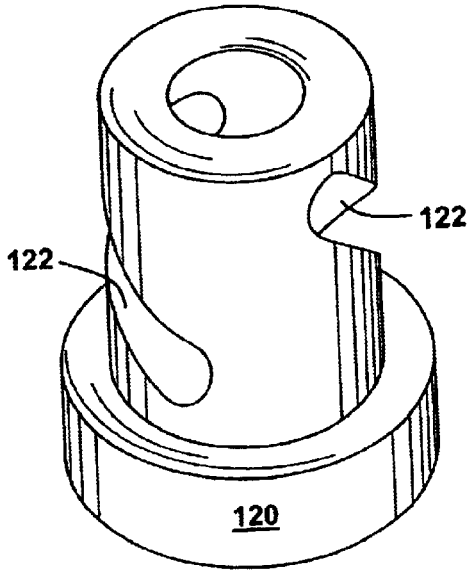

Below and abutting the liner sleeve 125 is the actuator sleeve 120 which is also surrounded by the actuator pin carrier 105 and which, as seen in FIGS. 3, 4, and 5 has at least one actuating slot 122 for receiving the actuating pin 107 of the actuator pin carrier 105. Note that at least one actuating pin 107 and at least one actuating slot 122 are required to accomplish the shift; however two and possibly more actuating pins and slots may be preferred for mechanical balance and smooth operation. The slots 122 of the actuator sleeve 120 lie on a spiral path, and they extend slightly more than 90° along the periphery of the sleeve, so that for each downward movement, and for each upward movement, of the actuator pin carrier 105, the actuator sleeve 120 rotates slightly more than 90°. Although the diverter valve plate only needs to turn 90° to shift cutting modes, the actuator sleeve must turn slightly more than that in order to permit engagement of the pawls 142 (FIGS. 6 and 7), attached to the control rod sleeve 140, with the next teeth 132 on the rachet wheel 130. A bearing member 135 is interposed between the actuator sleeve 120 and the shifter body 110 to facilitate the more than 90° oscillations of the actuator sleeve during mode shifting of the tool.

Figure 6:
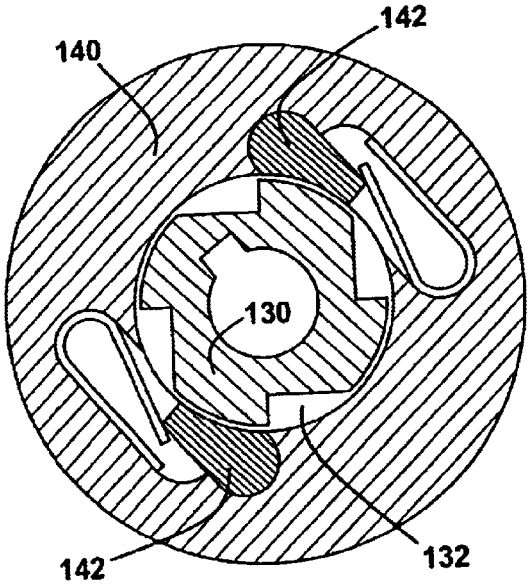
FIGS. 6 and 7 are two schematic end sectional views showing the rachet pawl feature in the control rod sleeve in its engaged and shifting positions, respectively.
Figure 7:
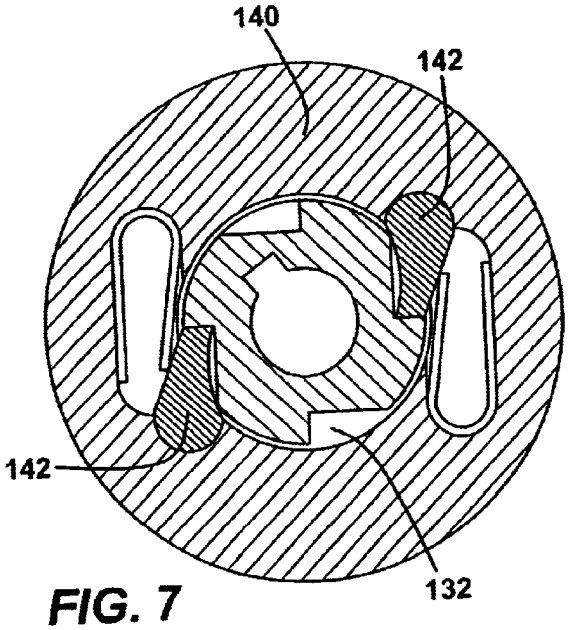

The lower control rod 115 has a rachet wheel 130 which has four teeth 132 spaced 90° apart about its periphery as seen in FIGS. 6 and 7. The teeth are adapted to receive spring loaded pawls 142 when turned more than 90° from their previous position. The pawls provide a rachet effect which permits the lower control rod 115 to turn in only one direction. Thus, when pressure is removed from the tool and the actuator sleeve 120 turns in response to the movement of the actuating pin 107, the lower control rod 115, driven by the pawls mounted on the control rod sleeve 140, rotates and turns the upper control rod 15 and the diverter valve plate 20 by 90° to shift the cutting mode of the decoking tool 10. When the pressure is re-applied to the tool, the actuator sleeve rotates more than 90° back to draw the pawls 142 into registry with the next teeth 132 and to arm the apparatus for the next cutting mode shift.

At least one spring 150, preferably three or more springs as shown in FIGS. 2 and 3, provide a strong bias against the actuator pin carrier 105 to maintain it at its topmost position against the annular piston 137 within the annular hydraulic cylinder 135 when the cutting fluid pressure is removed. It is this strong bias which provides the shifting power to rotate the diverter valve plate 20 when cutting pressure is removed from the decoking tool. The three or more springs design is preferred because it provides a redundant and stable balanced biasing force against the actuating pin carrier 105. Also seen in FIG. 3 is the engagement of the actuating pins 107 in the actuating slots 122 in the preferred two pin—two slot balanced embodiment of the invention. As noted above, the invention could operate with only one actuating pin 107, with only one actuating slot 122, and with only one biasing spring 150; however, for the sake of reliability, redundancy, and force balancing, two or more of each item are preferred. This improves reliability by dividing the load between more than one member which reduces wear and tear on each member. Redundancy is provided by the fact that, upon failure of any single member, there is still an active counterpart so that loss of one member reduces the operating speed and efficiency of the apparatus without completely disabling it. The improvement in force balance provided by dividing the loads between a plurality of members is obvious.

The "dead end" design of the annular cylinder 135, which expels all the cutting fluid from the cylinder through the same ports 133 through which the fluid entered, provides cleaning action which prevents accumulation of coke fines within the tool. Thus, with each depressurization of the tool, all the cutting fluid, together with suspended coke fines, admitted to the annular cylinder in the previous pressurization is expelled from the cylinder through its entrance ports with no flow-through. This is a significant improvement over prior art tools which had at least some flow-through of cutting fluid with resultant filtration and accumulation of coke fines which quickly jammed the shifting mechanisms and caused the tools to fail.

For a typical decoking operation, the decoking tool, set for drilling mode, is positioned above a coke drum, the top and bottom covers of which have been removed. The tool is lowered into the drum to a position above the solid coke body, and high pressure cutting fluid is fed through the tool to begin drilling the pilot hole through the coke bed After completion of the pilot hole, the cutting fluid pressure is turned off. This causes the springs 150 to push the actuator pin carrier 105 to the top of the shifter body 110, driving the annular piston 137 to the top of the annular hydraulic cylinder 135 and expelling all the cutting fluid from the cylinder through the same ports 133 through which it was admitted, thereby flushing-out any coke fines carried in with the cutting fluid. When the actuator pin carrier 105 rises to the top of the shifter housing 110, the actuating pin 107 rises with it and, because of its engagement in the actuating slot 122 of the annular actuating sleeve 120, causes the sleeve to turn back, which rotates the control rod sleeve 140 and the attached pawls 142, acting on the rachet wheel 130, to rotate the lower control rod 115 to drive the upper control rod 15 and turn the diverter plate 20 90° to shift the tool 10 to final cutting mode. The tool is raised to the top of the drum and cutting fluid pressure is again admitted to the annular cylinder 135 driving the annular piston 137 downward and reversing the actions caused by depressurization except that, when the actuator sleeve 120 rotates during pressurization, the pawls 142 on the control rod sleeve 140 withdraw from the teeth 132 in the rachet wheel 130 and engage in the next teeth 90° away, armed for the next cutting mode shift. The tool is rotated and lowered through the drum until all the coke has been removed, at which time the tool is depressurized, causing it to shift back to drilling mode, and withdrawn from the drum.

We claim:

1. A remotely operated cutting mode shifting apparatus for use with a decoking tool of the type in which a cutting mode is changed by rotation of a diverter valve plate to shift flow of a cutting fluid, said apparatus comprising:

a shifter body adapted for mounting to a decoking tool and having a control rod for engaging with a diverter valve plate;

means within said shifter body for rotating said control rod to drive said diverter valve plate to shift the cutting mode of the decoking tool upon release of cutting fluid pressure from the tool.

2. A remotely operated cutting mode shifting apparatus for use with a decoking tool of the type in which the cutting mode is changed by rotation of a diverter valve plate, the shifting apparatus comprising:

a shifter body adapted for mounting to a lower end of a decoking tool;

a liner sleeve abutting the lower end of the decoking tool and providing a gap within said shifter body, the gap defining an annular hydraulic cylinder surrounded by said shifter body and surrounding said liner sleeve, said hydraulic cylinder being filled with cutting fluid during cutting operations;

a lower control rod surrounded by said liner sleeve and engaged with an upper control rod in said decoking tool;

an annular piston fitted within said annular hydraulic cylinder;

an actuator pin carrier assembly situated within said shifter body below said annular piston and carrying at least one actuating pin extending radially inwardly therefrom;

an annular actuator sleeve fitted within said actuator pin carrier and having at least one actuating slot for engaging with said at least one actuating pin;

at least one spring member for forcing said actuator pin carrier to a topmost position within said shifter housing when cutting fluid pressure is released from said decoking tool; and means for releasably coupling said annular actuator sleeve to said lower control rod to rotate the lower control rod, the upper control rod, and the diverter plate to shift the cutting mode upon release of cutting fluid pressure from the tool.

3. The apparatus of claim 2, further comprising:

means for preventing accumulation, within said annular hydraulic cylinder, of coke fines from cutting fluid which fills said cylinder during cutting operations of the decoking tool.

4. The apparatus of claim 2, wherein the means for releasably coupling said lower control rod to said annular actuator sleeve comprises a rachet wheel on said control rod with four teeth spaced 90° apart about its periphery, said teeth being adapted to receive at least one spring-loaded pawl mounted upon a control rod sleeve, said control rod sleeve being attached to said actuator sleeve, said pawl permitting rotation of said control rod in only one direction.

5. A remotely operated cutting mode shifting apparatus for use with a decoking tool of the type in which the cutting mode is changed by rotation of a diverter valve plate, the shifting apparatus comprising:

a shifter body adapted for mounting to a lower end of a decoking tool and having a lower control rod for engaging with an upper control rod in said decoking tool;

a liner sleeve abutting the lower end of said decoking tool and providing a gap within the shifter body, the gap defining an annular hydraulic cylinder surrounded by said shifter body and surrounding said liner sleeve, said hydraulic cylinder being filled with cutting fluid during cutting operations;

an actuator pin carrier assembly situated within said shifter housing and carrying at least one actuating pin extending radially inwardly therefrom;

an annular actuator sleeve fitted within said actuator pin carrier and having at least one actuating slot for engaging with said at least one actuator pin;

at least one spring member for forcing said actuator pin carrier to a topmost position within said shifter body when cutting fluid pressure is released from said decoking tool; and a rachet wheel on said lower control rod with four teeth spaced 90° apart about its periphery, said teeth being adapted to receive at least one spring-loaded pawl, said pawl permitting rotation of said control rod in only one direction.

* * * * *